United States Patent [19]

Gahler et al.

[11] 4,034,278

[45] July 5, 1977

[54] CHARGING CIRCUIT FOR A FLASH CAPACITOR

[75] Inventors: Egon Gahler, Hattersheim; Hans Eberhard Heintke, Wachtersbach; Rolf Dietrich, Hofheim, all of Germany

[73] Assignee: Braun Aktiengesellschaft, Frankfurt, Germany

[22] Filed: Oct. 2, 1975

[21] Appl. No.: 618,997

[30] Foreign Application Priority Data

Oct. 2, 1974 Germany ..... 2446960

[52] U.S. Cl. ..... 320/1; 315/241 P; 323/22 SC

[51] Int. Cl.[2] ..... H02M 9/04; G05F 3/14

[58] Field of Search ..... 320/1; 307/108; 315/240, 241 R, 241 P; 323/22 SC

[56] References Cited

UNITED STATES PATENTS

| | | | |
|---|---|---|---|
| 3,274,475 | 9/1966 | Poss | 320/1 |
| 3,819,983 | 6/1974 | Bjork | 320/1 X |
| 3,831,079 | 8/1974 | Iwata | 320/1 X |

*Primary Examiner*—Stuart N. Hecker
*Attorney, Agent, or Firm*—Richard A. Wise; Oistein J. Bratlie; Raymond J. Devellis

[57] ABSTRACT

A circuit arrangement for charging a flash capacitor of a designated rated voltage from a DC source of a higher rated voltage. A thyristor in the line from the DC source is blocked when the voltage for which the flash capacitor is designed is reached.

10 Claims, 1 Drawing Figure

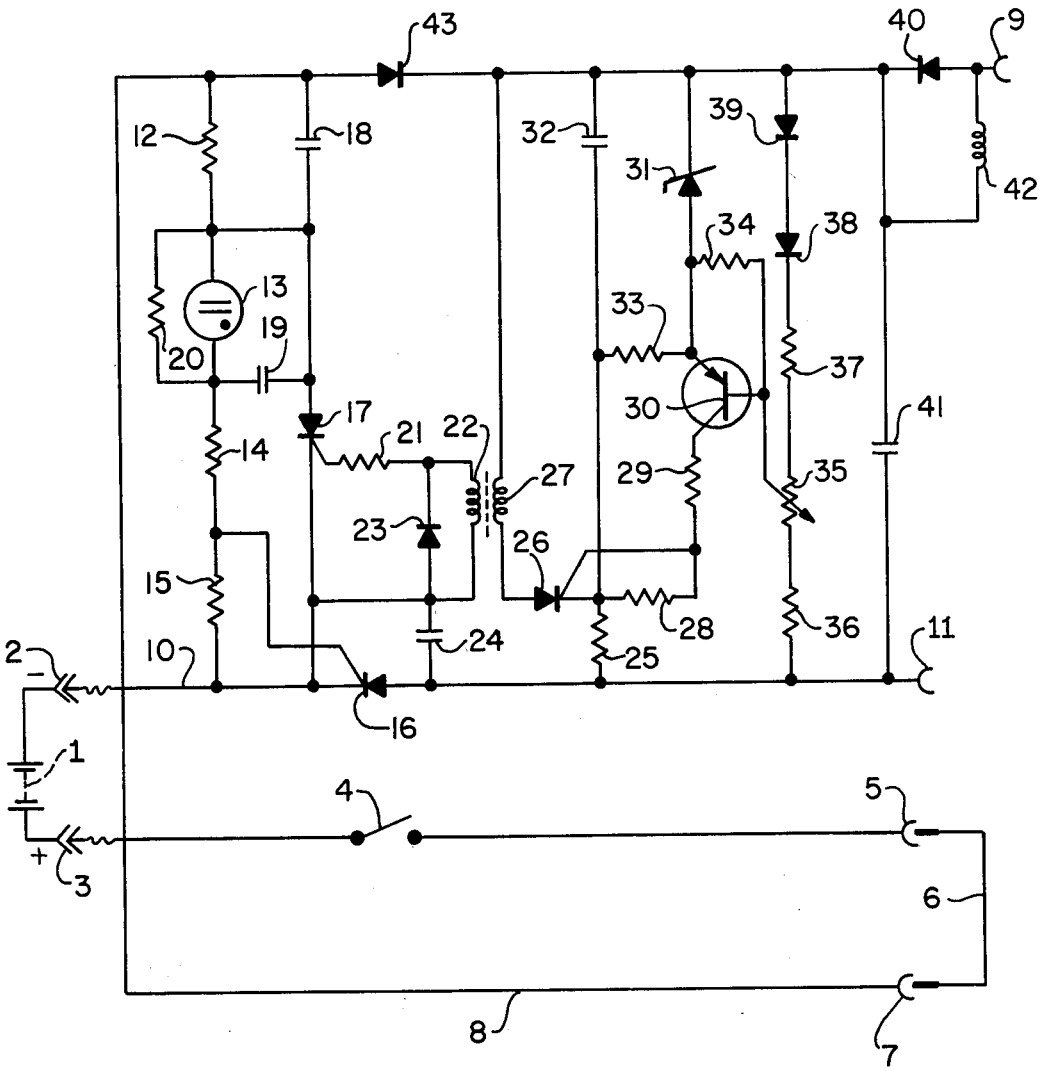
43
40
9
12
18
32
39
31
42
34
38
13
33
19
20
37
30
41
17
21
22
14
27
29
35
23
26
15
28
36
11
2
10
24
25
16
1
4
5
3
6
8
7

CHARGING CIRCUIT FOR A FLASH CAPACITOR

BACKGROUND OF THE INVENTION

This invention relates to circuitry used in electronic flash units normally associated with the photographic arts.

More particularly, this invention concerns a circuit arrangement for charging a flash from a direct voltage source, which provides a voltage larger than the voltage for which the flash capacitor is designed.

Flash capacitors are generally designed for quite definite voltage values. These voltage values, however, can be different in different countries. For example, in Europe, the voltages of electrolytic flash capacitors are typically set at 360 volts, while in the United States, they are typically set at 510 volts. Thus, a problem exists when an operator tries to operate a flash unit containing a flash capacitor set at 510 volts when the flash capacitor is designed to operate at 360 volts.

SUMMARY OF THE INVENTION

Briefly stated and according to an aspect of this invention, a circuit arrangement is adapt a flash capacitor designed for relatively low voltage to be charged at a higher voltage. According to this invention, this task is solved by providing a thyristor in the line from the higher direct voltage source to the flash capacitor. Circuitry is provided so that when the voltage for which the flash capacitor is designed is reached, the thyristor is blocked. An embodiment of the invention consists of providing a potentiometer connected in parallel with the flash capacitor to turn off by thyristor when the designated value of the flash capacitor is reached. A voltage proportional to the flash capacitor voltage is tapped from the potentiometer and is brought up to the base of a transistor. The transistor becomes conducting when the proper voltage level is reached. A thyristor is thus fixed which makes it possible for the flash capacitor to discharge over the primary coil of a transformer. A second thyristor is then fired over the secondary coil of the transformer. The second thyristor short circuits the voltage applied to the control electrode or gate of the first thyristor, thereby putting the cathode of the thyristor at a positive potential with respect to its anode.

It is, therefore, an object of this invention to provide circuitry in a flash unit which permits the charging of a flash capacitor to be controlled when a direct current voltage source is used by means of a thyristor.

It is a further object of this invention to provide a circuit arrangement for a flash unit to adapt a flash capacitor designed for a relatively low voltage to be charged at a higher voltage from a DC source.

BRIEF DESCRIPTION OF THE DRAWING

The invention, both as to its organization and principles of operation, together with further objects and advantages thereof, may better be understood by referring to the following detailed description of an embodiment of the invention taken in conjunction with the accompanying schematic representation of a circuit arrangement, in accordance with this invention.

Referring now to the drawing, a direct voltage battery 1 is connected through connecting plug 2 and 3 to the circuit arrangement according to the invention. A switch 4 is connected to connecting plug 3. By means of switch 4, connection can be made to a connecting socket 5. Connecting socket 5 can, on its part, be connected to a second connecting socket 7, with the aid of the bridge 6. Through a conductor 8 and through two oppositely connected diodes 43 and 40, connecting socket 7 makes an electric connection to a third connecting socket 9. Between conductor 8 and a conductor 10, which connects connecting plug 2 with another connecting socket 11, are located several electrical components. Thus, a connection exists from conductor 8 to conductor 10, through the series connection of a resistor 12, a neon glow lamp 13, a resistor 14 and another resistor 15.

A connection branches from the conductor between resistors 14 and 15 to the control electrode or gate of a thyristor 16. The anode/cathode path of this thyristor lies in conductor 10. The cathode of thyristor 16 is connected with the cathode of thyristor 17, whose anode is in turn connected to conductor 8 through a capacitor 18. Furthermore, another connection leads from the anode of thyristor 17, through a capacitor 19, which in turn is connected to the conductor between the neon tube 13 and resistor 14, through another resistor 20 and to the conductor between the neon tube 13 and resistor 12. From there, an electric path is completed through capacitor 18 to conductor 8.

The control electrode or gate of thyristor 17 is connected to a resistor 21, from which a connection leads over the secondary winding 22 of a transformer, to the cathodes of thyristors 16 and 17. A diode 23 is connected between the connecting conductor of secondary winding 22 with resistor 21 on the one hand, and the connecting conductor between the secondary winding 22 and the cathode of thyristor 16 on the other hand. Diode 23 is connected with its cathode in the direction of resistor 21. The connection point between the secondary winding 22 and the anode of diode 23 is connected through a capacitor 24 to the anode of thyristor 16. On its part the anode of thyristor 16 is furthermore connected to a resistor 25. The resistor 25 is connected to the cathode of thyristor 26, whose anode is connected through the primary winding 27 of the already mentioned transformer, to the cathode of a diode 43, which in turn is connected in conductor 8.

Furthermore, a path runs across from the cathode of thyristor 26 through a resistor 28, a resistor 29, the collector-emitter path of a transistor 30, and a Zener diode 31, to the cathode of diode 43. From there the electric path closes through a capacitor 32, which is connected to a first terminal of a resistor 33 as well as to the cathode of thyristor 26. The second terminal of resistor 33 is connected to the emitter of transistor 30, and resistor 34 lies between the base and the emitter of transistor 30. The base of transistor 30 furthermore lies at the tap of a potentiometer 35. Potentiometer 35 is connected on one side, through a resistor 36, to socket 11, and on the other side it is connected through a resistor 37, a diode 38, and another diode 39, to the cathode of diode 40, which in turn is connected to socket 9. The diodes 38 and 39 have a polarity so that their cathodes point in the direction of the resistor 37.

The cathode and anode of diode 40 are connected with one another through an inductor 42, whereby the cathode furthermore also is connected to socket 11 through an electrolytic flash capacitor 41.

In operation, when switch 4 is in the "off"position, i.e., open, during the quiescent state, the connection between sockets 5 and 7 can now be made through the bridge 6, and the entire circuit can be connected to the battery 1. The flash capacitor 41 should be discharged at this point.

If switch 4 is now closed, capacitors 18 and 19 are charged up through resistors 14 and 15. The voltage which whereby drops across resistor 15 drives thyristor 16. In this way the flash capacitor 41 is charged up through diode 43. Capacitor 24 prevents thyristor 16 from firing accidentally. At the same time, capacitor 32 is charged up through resistor 25, to the voltage essentially determined by the voltage divider consisting of resistors 25, 33, and diode 31.

In the meantime, neon glow lamp 13 is also lit up, since it is connected to the voltage of capacitor 19. A voltage is tapped from the voltage divider consisting of resistors 37, 35, and 36, and this voltage corresponds to the permissible or design voltage of the electrolytic flash capacitor 41. The operating voltage of Zener diode 31 here serves as reference voltage. Potentiometer 35 is set so that, when a voltage of, e.g., 360 volts exists at flash capacitor 41, the voltage across potentiometer 35, resistor 37, and diodes 38 and 39, exceeds the base-emitter voltage of transistor 30 required to drive transistor 30; transistor 30 thus becomes conducting. Diodes 38 and 39 here serve for temperature compensation. Slight over compensation can be achieved with diodes 38 and 39 so that, when the temperature rises, a lower voltage is tapped from the electrolytic capacitor 41.

To attain better long-term stability, a certain working current is already impressed on the Zener diode 31 before switch-off, through resistors 33 and 25. The collector current, which flows as a result of transistor 30 being driven, effects a voltage drop at resistor 28, which drives thyristor 26. Capacitor 32 then discharges through the primary winding 27 of the transformer. Along with the voltage discharge of capacitor 32, the voltage across the Zener diode 31 and the base-emitter voltage of transistor 30 also discharge.

In connection with voltage oscillations in the series oscillating circuit formed by capacitor 32 and primary winding 27, the cathode of thyristor 26 becoming positive for a short time, i.e., thyristor 26 is blocked. The voltage at capacitor 32 then builds up again, and the process begins anew. Pulses are induced in the secondary winding 22 of the transformer, through the discharge of capacitor 32. These pulses drive thyristor 17 and turn it on. At the same time, the neon glow lamp 13, resistor 14, and resistor 15 are short circuited. Neon glow lamp 13 is therefore extinguished. The voltage dropping over these elements is applied for a short time to the cathode of thyristor 16, namely until the capacitor 18 is charged up to the battery voltage.

The cathode thus becomes positive with respect to the anode, and thyristor 16 is blocked. Thus, the charging process of the flash capacitor 41 is interrupted.

If the charge current of capacitor 18 reaches a value below the holding current of thyristor 17, thyristor 17 blocks, and the voltage across the neon glow lamp 13 and resistors 14 and 15 rises. But before the firing voltage of neon glow lamp 13 is reached, a new control pulse appears at the control electrode or gate of thyristor 17. Thyristor 17 turns on, and the neon glow lamp is short circuited. Thus, the control electrode or gate of thyristor 16 is prevented from being driven, i.e. thyristor 16 continues to be blocked.

If the voltage at flash capacitor 41 falls on account of losses caused by the associated circuitry and components typically existing in a flash unit (not shown) and connected to the connecting sockets 9 and 11, until the base voltage at transistor 30 no longer suffices to maintain the collector current necessary for driving thyristor 26, no control pulses any longer reach the control electrode or gate of thyristor 17. The voltage at the neon glow lamp 13 rises to the firing voltage. Upon firing, the voltage collapses to the maintaining voltage. The current pulse drives the control electrode or gate of thyristor 16, through resistor 15. Thyristor 16 thus becomes conducting, and the electroyltic flash capacitor 41 again begins to be charged. The capacitor 19 improves the switching behavior of neon glow lamp 13.

While an embodiment and application of this invention has been shown and described, it will be apparent to those skilled in the art that many more modifications are possible without departing from the inventive concepts herein described. The invention, therefore, is not to be restricted except as necessary by the prior art and by the spirit of the appended claims.

What is claimed as new and desired to be served by Letters Patent of the United States is:

1. A circuit for charging a flash capacitor from a DC voltage source which provides a voltage larger than that for which the flash capacitor is designed comprising:

a first thyristor having a control electrode electrically connected in series between the DC voltage source and the flash capacitor;

circuit means electrically connected to the flash capacitor and said control electrode of said first thyristor for monitoring the voltage of the flash capacitor and for providing a control signal through said control electrode of said first thyristor for rendering said thyristor non-conducting when the designed voltage of the flash capacitor is exceeded, said circuit means including means for maintaining said control electrode of said first thyristor at a voltage proportional to the voltage of the DC voltage source sufficient to render said first thyristor conductive before the designed voltage of the flash capacitor is reached, said circuit means also including a variable resistance means electrically connected in parallel to the flash capacitor for rendering said first thyristor non-conducting when a predetermined voltage across the variable resistance means develops, said predetermined voltage being proportional to the voltage across the flash capacitor, said circuit means further including a transistor electrically connected between said variable resistance means and said first thyristor, said predetermined voltage rendering said transistor conductive; and a Zener diode electrically connected to the emitter of said transistor for providing a reference voltage at the designated voltage of the flash capacitor.

2. A circuit for charging a flash capacitor from a DC voltage source which provides a voltage larger than that for which the flash capacitor is designed comprising:

a first thyristor having a control electrode electrically connected in series between the DC voltage source and the flash capacitor;

circuit means electrically connected to the flash capacitor and said control electrode of said first thyristor for monitoring the voltage of the flash capacitor and for providing a control system signal through said control electrode of said first thyristor for rendering said thyristor non-conducting when the designed voltage of the flash capacitor is exceeded, said circuit means including means for maintaining said control electrode of said first thyristor at a voltage proportional to the voltage of the DC voltage source sufficient to render said first thyristor conductive before the designed voltage of the flash capacitor is reached, said circuit means also including a variable resistance means electrically connected in parallel to the flash capacitor for rendering said first thyristor non-conducting when a predetermined voltage across the variable resistance means develops, said predetermined voltage across the variable resistance means develops, said predetermined voltage being proportional to the voltage across the flash capacitor, said circuit means further including a transistor electrically connected between said variable resistance means and said first thyristor, said predetermined voltage rendering said transistor conductive; and said circuit means further including a second thyristor electrically connected between said transistor and said first thyristor, said second thyristor being rendered conductive when said transistor is rendered conductive when the designated voltage of the flash capacitor is reached.

3. The circuit as in claim 2 wherein said variable resistance means is potentiometer.

4. The circuit as in claim 3 further including diode means electrically connected in series with said potentiometer for providing temperature compensation to the circuit.

5. A circuit for charging a flash capacitor from a DC voltage source which provides a voltage larger than that for which the flash capacitor is designed comprising:

a first thyristor having a control electrode electrically connected in series between the DC voltage source and flash capacitor;

a variable resistance means electrically connected in parallel to the flash capacitor for rendering said first thyristor non-conducting when a predetermined voltage across said variable resistance means develops said predetermined voltage proportional to the voltage across the flash capacitor;

a transistor electrically connected between said variable resistance means and said first thyristor, said predetermined voltage rendering said transistor conductive; and a Zener diode electrically connected to the emitter of said transistor for providing a reference voltage at the designated voltage of the flash capacitor.

6. A circuit for charging a flash capacitor from a DC voltage source which provides a voltage larger than that for which the flash capacitor is designed comprising:

a first thyristor having a control electrode electrically connected in series between the DC voltage source and the flash capacitor;

a variable resistance means electrically connected in parallel to the flash capacitor for rendering said first thyristor non-conducting when a predetermined voltage across said variable resistance means develops said predetermined voltage proportional to the voltage across the flash capacitor;

a transistor electrically connected between said variable resistance means and said first thyristor, said predetermined voltage rendering said transistor conductive; and a second thyristor electrically connected between said transistor and said first thyristor, said second thyristor being rendered conductive when said transistor is rendered conductive in response to the designated voltage of the flash capacitor being reached.

7. The circuit as in claim 6 wherein said variable resistance means is a potentiometer.

8. The circuit as in claim 7 further including diode means electrically connected in series with said potentiometer for providing temperature compensation to the circuit.

9. A circuit for charging a flash capacitor from a DC voltage source which provides a voltage larger than that for which the flash capacitor is designed comprising:

a first thyristor having a control electrode electrically connected in series between the DC voltage source and the flash capacitor;

a variable resistance means electrically connected in parallel to the flash capacitor for rendering said first thyristor non-conductive when a predetermined voltage across said variable resistance means develops, said predetermined voltage being proportional to the voltage across the flash capacitor;

a transistor electrically connected between said variable resistance means and said first thyristor, said predetermined voltage rendering said transistor conductive;

a second thyristor electrically connected between said transistor and said first thyristor, said second thyristor being rendered conductive when said transistor is rendered conductive in response to the designated voltage of the flash capacitor being reached; and a third thyristor electrically coupled to said control electrode of said first thyristor for short circuiting the voltage applied to said control electrode.

10. The circuit as in claim 9, further including a neon glow lamp electrically connected in parallel with said third thyristor, said neon glow lamp being short circuited by said thyristor when said third thyristor is rendered conductive.

* * * * *

UNITED STATES PATENT OFFICE

CERTIFICATE OF CORRECTION

PATENT NO. : 4,034,278

DATED : July 5, 1977

INVENTOR(S) : Egon Gahler, Hans Eberhard Heintke, Rolf Dietrich

It is certified that error appears in the above-identified patent and that said Letters Patent are hereby corrected as shown below:

Column 1, Line 9, after "flash" insert --capacitor--.

Column 1, Line 24, after "is" insert --provided to--.

Column 1, Line 33, after "off" change "by" to --the--.

Column 1, Line 39, after "thus" change "fixed" to --fired--.

Column 4, Line 66, after "control" delete --system--.

Column 5, Lines 12 and 13, after "develops," delete --said predetermined voltage across variable resistance means develops,--.

Column 5, Line 40, after "and" insert --the--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*